US006722059B2

(12) United States Patent
Robinson, Jr. et al.

(10) Patent No.: US 6,722,059 B2
(45) Date of Patent: Apr. 20, 2004

(54) DYNAMIC AND STATIC CUSHIONING FOOTBED

(75) Inventors: Douglas K. Robinson, Jr., Mansfield, MA (US); John F. Lane, III, Rockland, MA (US); John J. Erickson, Brockton, MA (US); James M. Feeney, Dedham, MA (US)

(73) Assignee: Acushnet Company, Fairhaven, MA (US)

( * ) Notice: Subject to any disclaimer, the term of this patent is extended or adjusted under 35 U.S.C. 154(b) by 116 days.

(21) Appl. No.: 10/057,276

(22) Filed: Oct. 25, 2001

(65) Prior Publication Data

US 2003/0140524 A1 Jul. 31, 2003

(51) Int. Cl.[7] ..... A43B 13/20
(52) U.S. Cl. ..... 36/29
(58) Field of Search ..... 36/29, 153, 28, 36/114, 35 B

(56) References Cited

U.S. PATENT DOCUMENTS

| | | | | | |
|---|---|---|---|---|---|
| 508,034 | A | | 11/1893 | Moore | |
| 547,645 | A | | 10/1895 | Lacroix | |
| 850,327 | A | | 4/1907 | Tauber | |
| 940,564 | A | | 11/1909 | Tauber | |
| 1,069,001 | A | | 7/1913 | Guy | |
| 1,193,608 | A | | 8/1916 | Poulson | |
| 1,539,199 | A | | 5/1925 | Merrihew | |
| 1,605,985 | A | | 11/1926 | Rasmussen | |
| 2,080,499 | A | * | 5/1937 | Nathansohn | 36/29 |
| 2,477,588 | A | | 8/1949 | Dumm | |
| 2,488,382 | A | * | 11/1949 | Davis | 36/153 |
| 2,549,343 | A | | 4/1951 | Stoiner | |
| 2,645,865 | A | * | 7/1953 | Town | 36/153 |
| 3,180,039 | A | | 4/1965 | Burns, Jr. | |
| 3,469,576 | A | | 9/1969 | Smith et al. | |
| 3,724,106 | A | | 4/1973 | Magidson | 36/44 |
| 3,765,422 | A | | 10/1973 | Smith | 128/594 |
| 3,871,117 | A | | 3/1975 | Richmond et al. | 36/43 |
| 3,922,801 | A | | 12/1975 | Zente | 36/44 |
| 4,017,931 | A | | 4/1977 | Golden | 12/146 |
| 4,100,686 | A | | 7/1978 | Sgarlato et al. | 36/29 |
| 4,115,934 | A | | 9/1978 | Hall | 36/44 |
| 4,123,855 | A | * | 11/1978 | Thedford | 36/29 |
| 4,217,705 | A | | 8/1980 | Donzis | 36/29 |
| 4,227,320 | A | | 10/1980 | Borgeas | 36/88 |
| 4,237,625 | A | | 12/1980 | Cole et al. | 36/28 |
| 4,446,634 | A | | 5/1984 | Johnson et al. | 36/29 |
| 4,458,430 | A | | 7/1984 | Peterson | 36/28 |
| 4,768,295 | A | | 9/1988 | Ito | 36/28 |
| 4,802,289 | A | | 2/1989 | Guldager | 36/43 |
| 4,934,072 | A | | 6/1990 | Fredericksen et al. | 36/29 |
| 5,131,174 | A | | 7/1992 | Drew et al. | 36/35 |
| RE34,102 | E | | 10/1992 | Cole et al. | 36/28 |
| 5,167,999 | A | | 12/1992 | Wang | 428/178 |
| 5,179,792 | A | | 1/1993 | Brantingham | 36/29 |
| 5,287,638 | A | | 2/1994 | Preston | 36/28 |
| 5,313,717 | A | | 5/1994 | Allen et al. | 36/28 |
| 5,333,397 | A | * | 8/1994 | Hausch | 36/3 B |
| 5,667,895 | A | | 9/1997 | Jenkner | 428/424.4 |
| D402,452 | S | | 12/1998 | Allen | D2/961 |
| 5,878,510 | A | | 3/1999 | Schoesler | 36/43 |
| 5,894,687 | A | | 4/1999 | Lin | 36/141 |
| 5,896,681 | A | | 4/1999 | Lin | 36/28 |
| 5,896,682 | A | | 4/1999 | Lin | 36/29 |
| 5,939,157 | A | | 8/1999 | Allen et al. | 428/35.7 |
| 5,950,332 | A | | 9/1999 | Lain | 36/3 |
| 5,979,086 | A | | 11/1999 | Vindriis | 36/153 |
| 6,178,663 | B1 | * | 1/2001 | Schoesler | 36/29 |
| 6,408,543 | B1 | * | 6/2002 | Erickson et al. | 36/29 |

FOREIGN PATENT DOCUMENTS

| | | |
|---|---|---|
| WO | WO 95/00047 | 1/1995 |

* cited by examiner

*Primary Examiner*—Ted Kavanaugh

(57) ABSTRACT

A footbed is disclosed that is for use with a shoe. The footbed includes static and dynamic chambers for cushioning a wearer's foot. The static chambers are isolated from one another and the dynamic chambers. The dynamic chambers are in fluid communication and fluid therein is free to flow during a wearer's walk cycle.

10 Claims, 6 Drawing Sheets

DYNAMIC AND STATIC CUSHIONING FOOTBED

TECHNICAL FIELD OF THE INVENTION

The present invention relates to shoes, and more particularly, relates to an improved footbed for use with golf shoes.

BACKGROUND OF THE INVENTION

Golf shoes generally include a shoe upper joined to a midsole to define a chamber for receiving the golfer's foot. The midsole is usually joined to an outsole on an outer surface for interacting with the ground. The inner surface of the midsole is adjacent a footbed that rests within the chamber of the shoe and contacts the wearer's sole. The midsole and footbed provide cushioning for the wearer's foot so they are typically formed of materials that are softer than the outsole material.

In one round of eighteen holes of golf a golfer may walk about 4 to 5 miles. Over such distances a golfer's health can depend on their shoes as various foot and, less obviously, back problems can be linked to footwear. During this activity, a golfer's performance also depends on the ability of the golfer's shoes to provide a solid base of support and provide necessary cushioning.

Shoes should be both comfortable and stable. Comfortable shoes are those that allow natural foot movements during walking which means forefoot flexibility and that allow torsion movement between forefoot and the rear of the foot. Golf shoes should be rigid in the lateral direction for good stability when hitting the ball. In general, a very comfortable shoe does not provide sufficient support and a very stable shoe may be too stiff and heavy. These competing requirements must be balanced in order to provide the best of both.

One example of a cushioning sole construction in a shoe is disclosed in U.S. Pat. No. 4,458,430 to Peterson. The shoe construction in this patent has a sole with two cushions which are filled with fluid of a particular viscosity and the cushions are interconnected by a number of channels. One cushion is positioned underneath the heel of the foot and the other is position underneath the transverse forward arch of the foot. When wearers put down their heels on the ground, fluid is forced forwards from the rear cushion through the channels to the forward cushion which expands. When the front arch of the foot is depressed, fluid is forced from the forward cushion to the rear cushion which expands. In this shoe, cushioning of the portion of the wearer's foot not resting on the fluid-filled cushions or channels relies only by the sole material.

There remains a need for footbeds, which are easy to manufacture and improve the cushioning of a wearer's entire foot.

SUMMARY OF THE INVENTION

The present invention relates to a footbed comprising dynamic and static air chambers. To that end, the footbed includes a base and a layer of material joined to one side of the base such that at least one first or static chamber and a plurality of second or dynamic chambers are formed between the base and the layer. Each static chamber is isolated from the other chambers, each dynamic chamber is in fluid communication with the other dynamic chambers.

In one embodiment, the dynamic chambers includes fluid, and a volume of the fluid in these chambers is less than a total internal volume of these chambers. As a result, the fluid can be easily displaced from one dynamic chamber to the other such chambers during a wearer's walk cycle.

In another embodiment, the footbed includes a plurality of first chambers. These first chambers can be located in the toe section, the shank section or the heel section of the foot bed.

According to one feature of the present invention, the dynamic chambers can include at least one forefoot chamber, a heel chamber, and a shank chamber. The shank chamber extends between the forefoot chambers and the heel chamber.

According to another feature of the present invention, the static chambers can be filled with fluid or with air and discrete pieces of cushioning material. In this embodiment, the cushioning material may be formed of thermoplastic rubber.

According to another embodiment of the present invention, it is directed to a shoe comprising an upper, a midsole, an outsole, and a footbed. The upper, midsole, and outsole are joined together to define an opening for receiving the footbed. The footbed includes a base with a lower surface and a layer of material. The layer of material is coupled to the lower surface of the base so that static and dynamic chambers are formed between the lower surface of the base and the layer of material. The static chambers are isolated, and the dynamic chambers are in fluid communication with one another.

According to one embodiment of such a shoe, the foot bed is removable. According to another embodiment of such a shoe, the second chambers include forefoot, shank and heel chambers.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
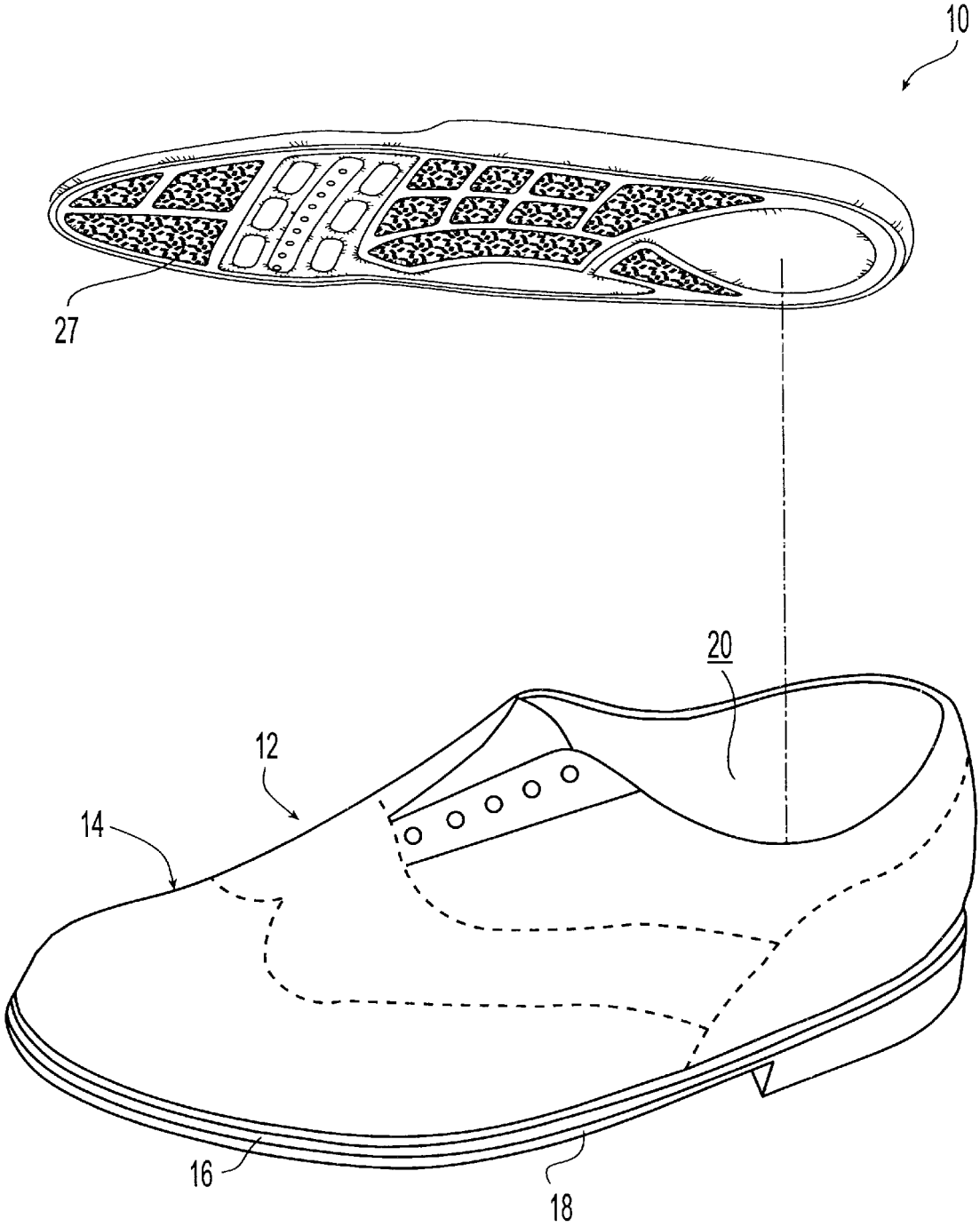
FIG. 1 is an exploded, perspective view of a first embodiment of a footbed of the present invention and a shoe.

Referring to FIG. 1, there is illustrated an embodiment of a footbed 10 according to the present development for placement in a golf shoe 12. In this embodiment, the footbed 10 is removable from the shoe 12, however in another embodiment the footbed 10 can be secured to the shoe permanently by adhesive or the like.

Golf shoe 12 includes an upper 14, a midsole 16, and an outsole 18. The upper 14 is conventional and formed from a suitable material, such as leather, a synthetic leather, or the like. The upper 14 is joined to the midsole 16 using cement or the like and conventional techniques. Once the upper 14 and midsole 16 are joined, the upper 14 defines an opening 20 for receiving the footbed 10 and a wearer's foot W (shown in FIG. 5).

The midsole 16 provides cushioning to the wearer, and is formed of a material such as ethylene vinyl acetate copolymer (EVA). The midsole 16 is coupled to the outsole 18. Once the midsole and outsole are joined, the outsole forms the bottom of shoe 12.

The outsole 18 is formed from a material that is flexible, abrasion resistant, light weight, and inexpensive. Recommended materials are ethyl vinyl acetate, rubber, and thermoplastic urethane. If the outsole is formed of ethyl vinyl acetate or rubber, it should be compression molded. If the outsole is formed of thermoplastic urethane, it should be injection molded. The outsole and midsole may include receptacles and spikes or cleats connectable to the receptacles, as known by those of ordinary skill in the art.

Figure 2:
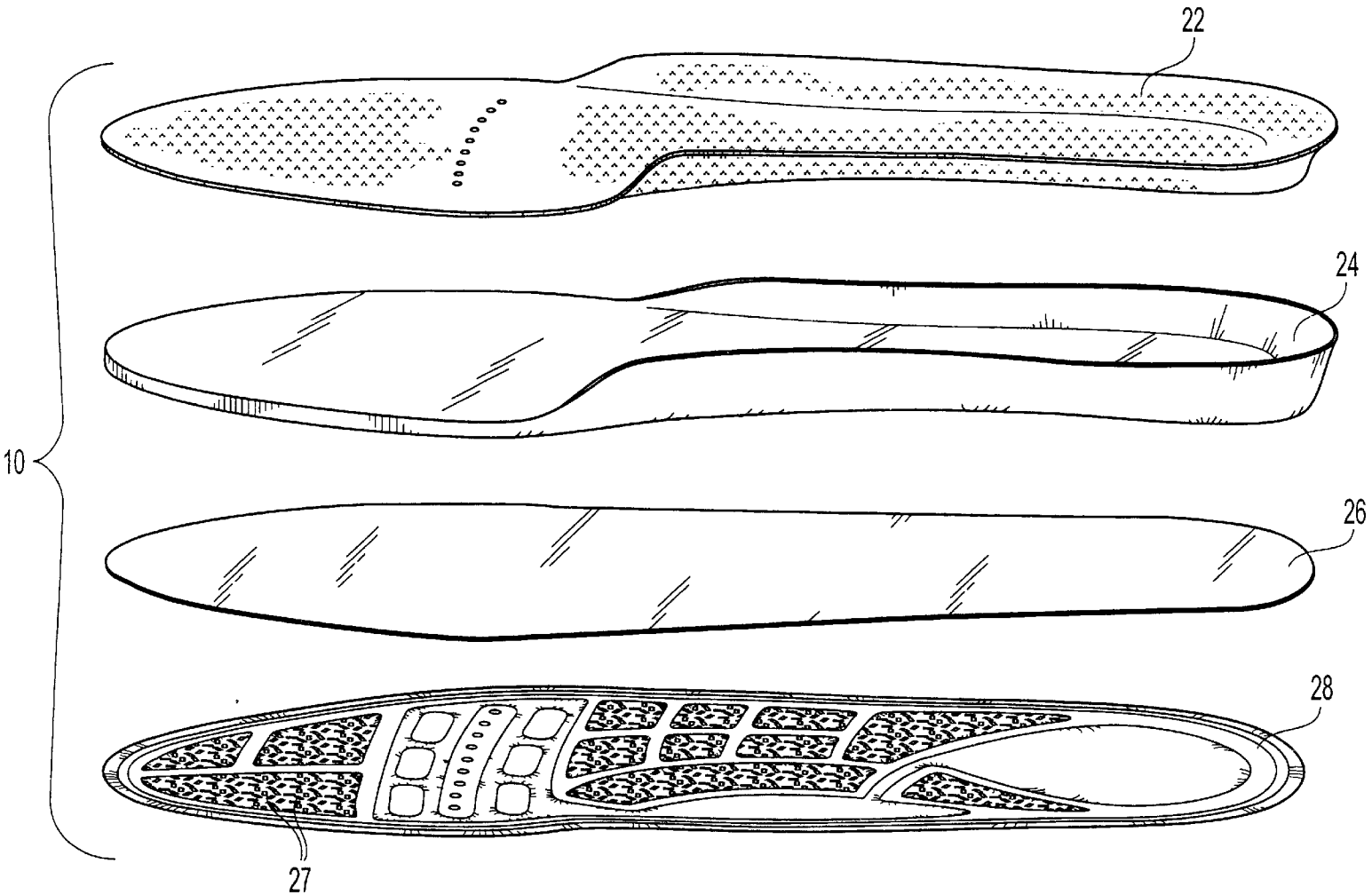
FIG. 2 is an exploded view of the footbed of FIG. 1 before it is assembled.

Referring to FIGS. 1–2, footbed 10 includes a four layers 22, 24, 26, 28. Preferably from top to bottom, the first layer 22 is formed of felt, the second layer 24 is foam, the third layer 26 is a synthetic fabric material, and the fourth layer 28 is a plastic material. The first layer 22 can also be formed of nylon, leather, Dri-Lex®, or other suitable materials. Dri-Lex® is made by Faytex Corp. of Weymouth, Mass. The second layer 24 foam may be formed of EVA or a polyvinyl-based material. The Third layer 26 is optional. The fourth layer may be formed of a polyvynial-based material, such as polyvinyl chloride (PVC).

Figure 3:
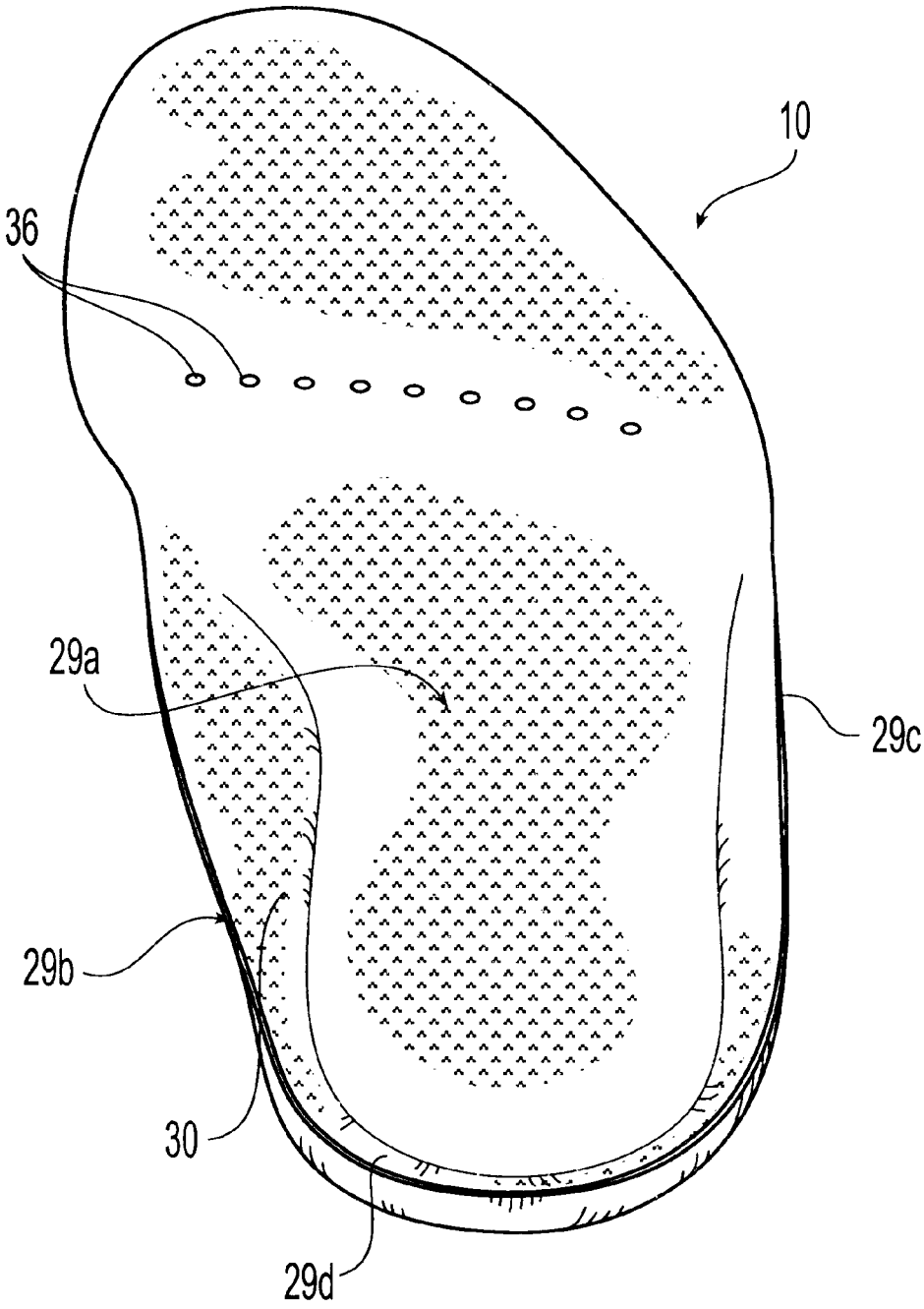
FIG. 3 is a rear, perspective view of the footbed of FIG. 1.

Referring to FIG. 3, preferably when the footbed 10 is formed it includes a bottom wall 29*a*, side walls 29*b,c*, and back wall 29*d*. The side walls 29*b,c* and back wall 29*d* extend upwardly from the bottom wall 29*a*. Preferably, the medial side wall 29*b* is configured at arch portion 30 to support the arch area of a wearer's foot.

Referring again to FIG. 2, the first layer 22 is joined to the upper surface of the foam layer 24 using conventional techniques, such as cementing. Then, the third layer 26 is joined to the bottom surface of the foam layer 24 using conventional techniques, such as cementing. Next, small discrete pieces of cushioning material 27 are disposed between the layer 26 and the plastic layer 28 in predetermined locations as discussed below. The layers 26 and 28 are contacted to one another and then contacted with heated elements to form of the seals 31*a–c* (shown in FIG. 4). The heated elements or thermoforming bonding equipment used is commercially available from Ding Tai Electric Industry Co., Ltd. under the name High Frequency Elecronic Filterable Heater. During the final sealing process, air is injected at the same time that the final seal 31*c* is completed. This step is done using a Fully-Automatic Forming Machine by Hann Rong Industrial Co., Ltd.

Figure 4:
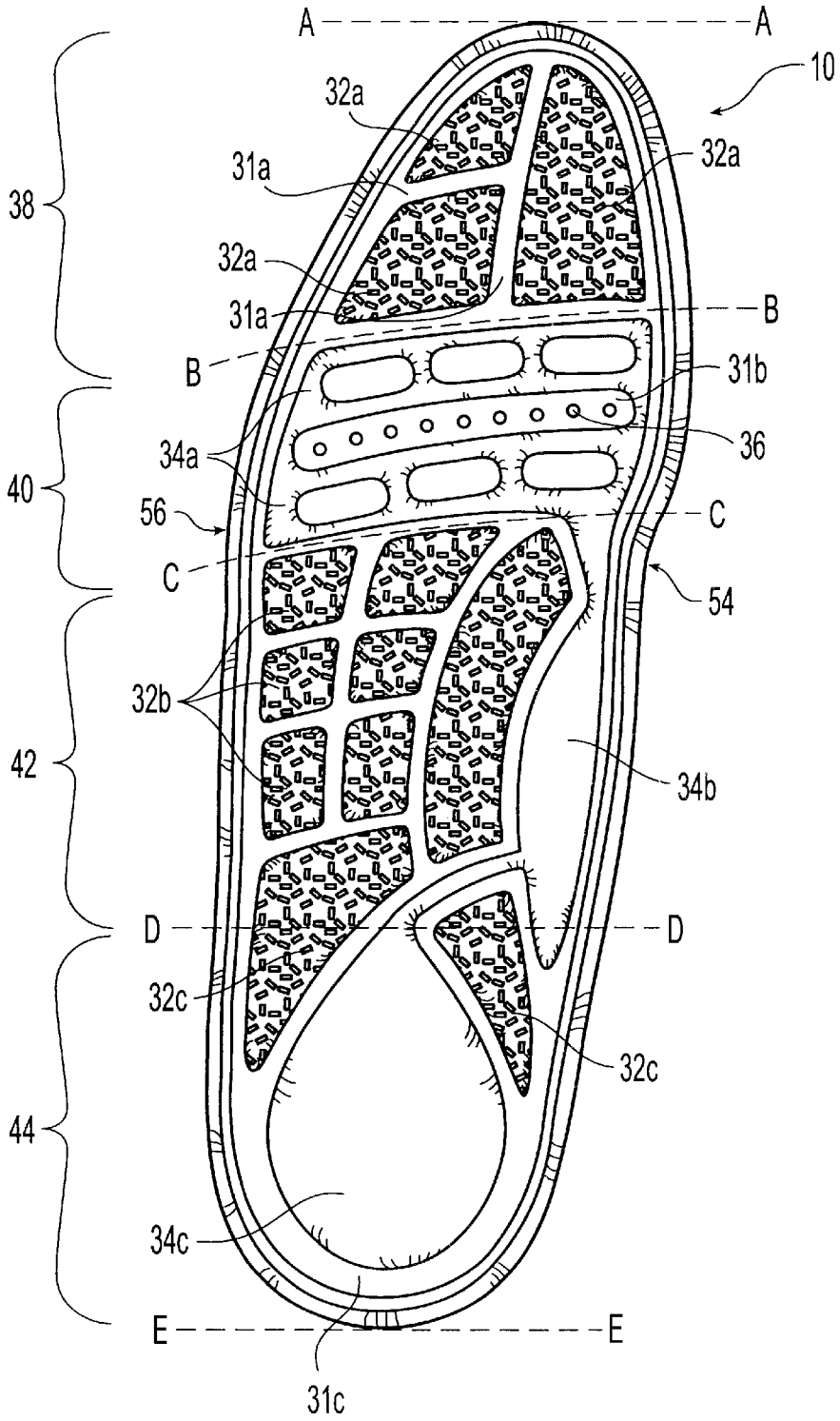
FIG. 4 is a bottom view of the footbed of FIG. 1.

As a result, as shown in FIG. 4, first or static chambers 32*a–c* are formed between the base which includes the layers 22–26 and the plastic layer 28 or more specifically these chambers are formed between layers 26 and 28. Similarly, second or dynamic chambers 34*a–c* are formed between layers 26 and 28. The joining of the layers can occur in individual steps or simultaneously.

Seals 31*a* are formed between separate chambers to isolate the static chambers 32*a–c* from one another and from the dynamic chambers 34*a–c*. This isolation means that the static chambers 32*a–c* are not in fluid communication with one another or with the dynamic chambers 34*a–c*. On the other hand, the dynamic chambers 34*a–c* are in fluid communication with one another.

Seal 31*b* is formed within the chamber 34*a* to produce flow channels as discussed below. During formation of the footbed, holes 36 are formed in the central seal 31*b* so that air can flow through the footbed 10.

The footbed 10 is defined by a plurality of sections: the toe section 38, the forefoot section 40, the shank section 42, and the heel section 44. The toe section 38 is defined as the section of the footbed 10 that underlies the toes of a wearer's foot, and is depicted as the section between lines AA and BB. The forefoot section 40 is defined as the section of the footbed 10 that underlies the metatarsal pad of the wearer's foot, and is depicted as the section between lines BB and CC. The shank section 42 is defined as the section of the footbed 10 that underlies the arch of the wearer's foot, and is depicted as the section between lines CC and DD. The heel section 44 is defined as the section of the footbed 10 that underlies the heel of the wearer's foot and is depicted as the section between lines DD and EE.

It is preferred that there are at least one static chamber, more preferably there are at least two static chambers in each of the toe, shank and heel sections 38, 42, and 44. Most preferably, the static chambers are arranged so that the group of static chambers 32*a* are located only toe section 38 of the footbed 10; the group of static chambers 32*b* are located only in the shank section 42 of the footbed 10; and the group of static chambers 32*c* are located in both the shank and the heel sections 42 and 44 of the footbed 10.

It is preferred that there is at least three dynamic chambers. More preferably, there is at least one dynamic forefoot chamber 34*a*, at least one dynamic shank chamber 32*b*, and at least one dynamic heel chamber 34*c*. Most preferably, there are two dynamic forefoot chambers 34*a* located in the forefoot section 40 of the footbed 10; the longitudinally extending dynamic shank chamber 34*b* in the shank section 42 of the footbed 10; and the dynamic heel chamber 34*c* that is substantially in the heel section 44 of the footbed 10. The shank chamber 34*b* extends between the forefoot chambers 34*a* and the heel chamber 34*c*, and fluidly connects chambers 34*a* and 34*c* together.

Figure 5:
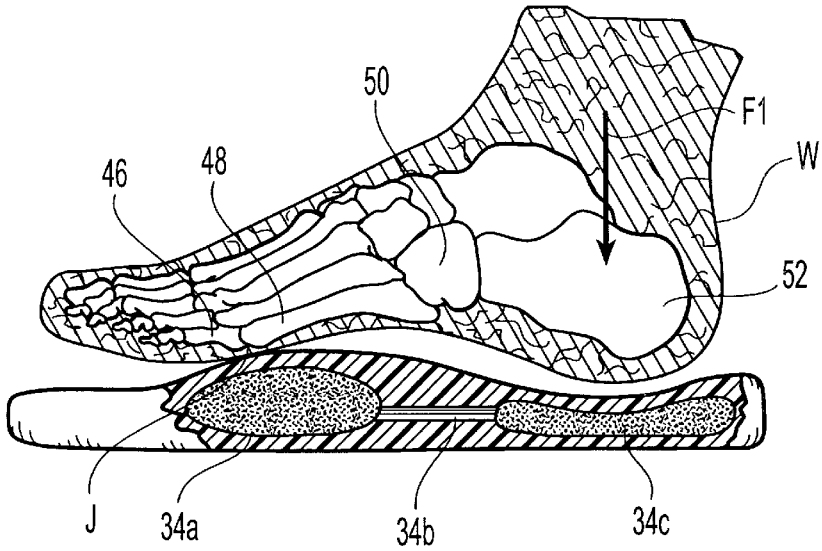
FIG. 5 is a partial cross-sectional view of a user's foot and the footbed during a heel strike of a walk cycle wherein a portion of the shoe has been removed for clarity.

The present invention is not limited to the above disclosed locations of the chambers 32*a–c* and 34*a–c*. It is recommended, however, that the dynamic forefoot chambers 34*a* are located such that they will be below the joint J between the wearer's phalanges bones 46 and metatarsus bones 48, as shown in FIG. 5. It is also recommended that the dynamic shank chamber 34*b* is located such that it will be below the arch of the wearer's foot or the cuboid bone 50. It is further recommended that the dynamic heel chamber 34*c* is located such that it will be substantially below the wearer's calcaneus bone 52.

The present invention is not limited to the shapes of the chambers 32*a–c* and the chambers 34*a–c* shown in the drawings. Preferably, as shown in FIG. 4, the dynamic forefoot chamber 34*a* extends substantially from a medial edge 54 of the footbed to a lateral edge 56 of the footbed 10. Preferably, the dynamic shank chamber 34*b* is located adjacent the medial edge 54 of the footbed so that it underlies the arch section of a wearer's foot, and has a generally crescent shaped central portion. The heel chamber 34*c* is tear-drop shaped with the larger end being rearward of the narrower end. The present invention, however, is not limited to these shapes. The static chambers 32*b* are located between the lateral edge 56 and the dynamic shank chamber 34*b*.

During forming of the footbed, the static chambers 32*a–c* are filled with fluid. More preferably, these chambers 32*a–c* include air and discrete pieces of cushioning material 27. One recommended cushioning material is thermoplastic rubber.

The dynamic chambers 34*a–c* are also filled with fluid and are in fluid communication with one another. More preferably, the chambers 34*a–c* have a volume of fluid that is less than the total internal volume of the chambers 34*a–c* so that the fluid therein can be easily displaced from one of the dynamic chambers to the other dynamic chambers during a wearer's walk cycle.

Referring to FIG. 5, during a heel strike of a wearer's walk cycle, the heel or calcaneus bone 52 exerts a force F1 downward on the dynamic heel chamber 34*c*. As a result, the fluid in chamber 34*c* flows into the dynamic shank and forefoot chambers 34*b* and 34*a* in turn. This cushions the heel during this heel strike.

Figure 6:
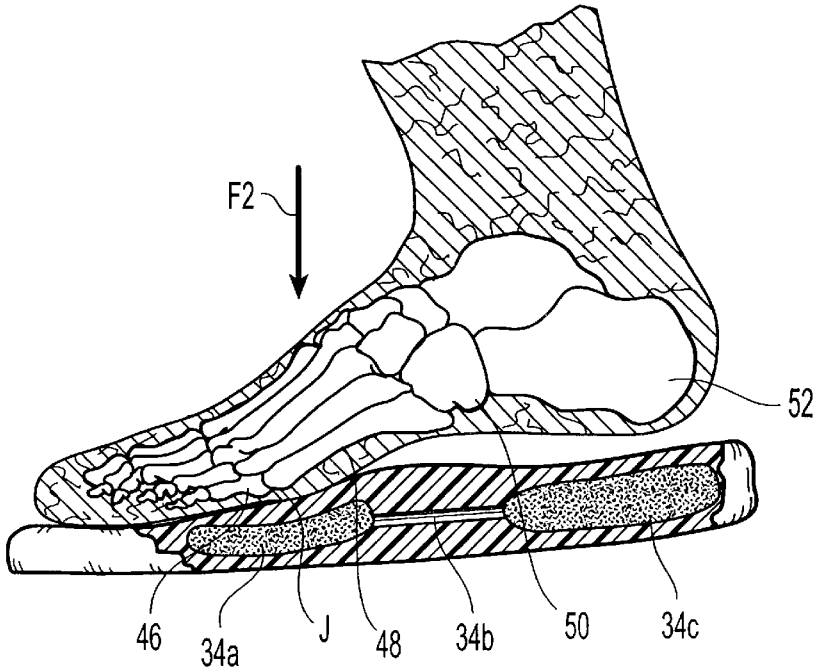
FIG. 6 is a partial cross-sectional view of the user's foot and the footbed during a toe strike of a walk cycle wherein a portion of the shoe has been removed for clarity.

Referring to FIG. 6, during a toe strike of a wearer's walk cycle, the front of the foot or joint J exerts a force F2 downward on the dynamic forefoot chamber 34*a*. As a result, the fluid in chamber 34*a* flows into the dynamic shank and heel chambers 34*b* and 34*c* in turn. This cushions the front of the foot during this toe strike.

This dynamic cushioning is supplemented by the static cushioning provided by the static chambers 32*a–c*, as shown in FIG. 4.

Figure 7:
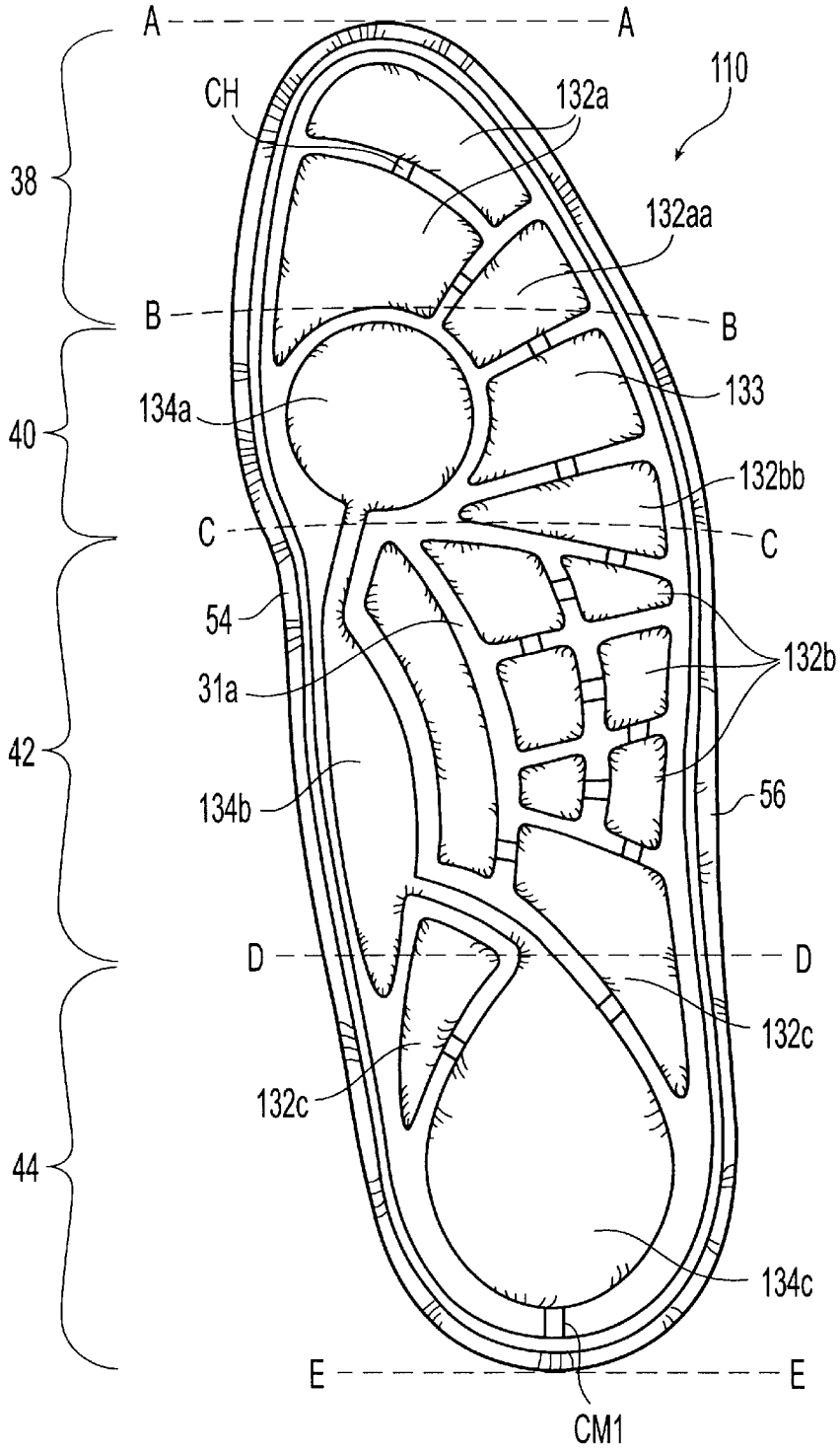
FIG. 7 is a bottom view of a second embodiment of a footbed of the present invention.

Referring to FIG. 7, another embodiment of the footbed 110 is shown. The footbed 110 includes the toe, forefoot, shank and heel sections 38–44 as described above. The footbed 110 is formed similarly to footbed 10 shown in FIG. 4. The footbed 110 includes static chambers 132*a* only in the toe section 38, static chamber 132*aa* in the toe and forefoot sections 38 and 40, static chamber 133 only in the forefoot section 40, static chamber 132*bb* in the forefoot and shank sections 40 and 42, static chambers 132*b* only in the shank section 42, and static chambers 132*c* in the shank and heel sections 42 and 44. The chambers 132*a*, 132*aa*, 132*b*, 132*bb*, 133, and 132*c* are isolated as discussed above by seals 31*a*. In this embodiment, the static chambers only include fluid or air, however, the cushioning material discussed above can also be used.

The footbed 110 further includes dynamic chambers 134*a–c*. Dynamic forefoot chamber 134*a* is located in the forefoot section 40 and has a circular shape. Dynamic shank chamber 134*b* is located in the shank section 42 between the forefoot chamber 134*a* and the heel chamber 134*c* and fluidly connects chambers 134*a* and 134*b*. Dynamic heel chamber 134*c* is located solely in the heel section 44 and has a tear-drop shape. Dynamic chambers 134*a–c* include air that moves between the chambers during a walk cycle as discussed above with respect to footbed 10.

The footbed 110 is formed slightly differently from footbed 10. The static and dynamic chambers are formed together and are initially all in fluid communication through channels CH. The chambers are filled with air via channel CH1 after the layers of the footbed 110 are joined together. Then channels CH are sealed to isolate the static chambers and form the dynamic chambers.

While it is apparent that the invention herein disclosed is well calculated to fulfill the objects above stated, it will be appreciated that modifications and other embodiments may be devised by those skilled in the art. For example, the footbeds can be provided separately from the shoes in a kit and the footbeds can be provided with different levels of cushioning by varying the air pressure and amount and/or type of cushioning material in the chambers so that a wearer can customize their footbed to their needs. The embodiments above can be modified so that some features of one embodiment are used with the features of another embodiment. It is intended that the appended claims cover all such modifications and embodiments as fall within the true spirit and scope of the present invention.

What is claimed is:

1. A footbed comprising:

a base comprised of top layer joined to an upper surface of a foam layer; and a bottom layer of material joined to a bottom side of the base such that at least one first chamber and a plurality of second chambers are formed between the base and the bottom layer, and each first chamber is isolated and each second chamber is in fluid communication with the other second chambers;

the first chambers being comprised of at least two chambers in a toe section, a shank section and a heel section; and the second chambers being comprised of a forefoot chamber, a shank chamber and a heel chamber being located below a user's calcaneus bone such that during the user's walk cycle, the user's calcaneus bone exerts a force on the heel chamber forcing fluid into the shank and forefoot chambers; and wherein a plurality of first chambers that are located in the shank section are between a lateral edge of the footbed and the shank chamber.

2. The footbed of claim 1, wherein a volume of the fluid in the second chambers is less than a total internal volume of the second chambers such that the fluid can be easily displaced from one second chamber to the other second chambers during a wearer's walk cycle.

3. The footbed of claim 1, wherein the forefoot chamber extends substantially from a lateral edge of the footbed to a medial edge of the footbed.

4. The footbed of claim 1, further including at least two forefoot chambers.

5. The footbed of claim 1, wherein the shank chamber is located adjacent the medial edge of the footbed.

6. The footbed of claim 1, wherein the shank chamber is located in an arch section of the footbed.

7. The footbed of claim 1, wherein the first chambers are filled with fluid.

8. The footbed of claim 7, wherein the first chambers are filled with air and discrete pieces of cushioning material.

9. The footbed of claim 8, wherein the cushioning material is formed of thermoplastic rubber.

10. The footbed of claim 1, wherein the second chambers are filled with air.

* * * * *